US010093101B2

(12) United States Patent
Nishikawa

(10) Patent No.: US 10,093,101 B2
(45) Date of Patent: Oct. 9, 2018

(54) LIQUID CONSUMING APPARATUS AND INK-JET PRINTER

(71) Applicant: BROTHER KOGYO KABUSHIKI KAISHA, Nagoya-shi, Aichi-ken (JP)

(72) Inventor: Yasuo Nishikawa, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/335,855

(22) Filed: Oct. 27, 2016

(65) Prior Publication Data

US 2017/0120605 A1 May 4, 2017

(30) Foreign Application Priority Data

Oct. 30, 2015 (JP) ..... 2015-214610

(51) Int. Cl.
*B41J 2/17* (2006.01)
*B41J 2/185* (2006.01)

(52) U.S. Cl.
CPC ..... *B41J 2/1721* (2013.01); *B41J 2/185* (2013.01); *B41J 2002/1742* (2013.01); *B41J 2002/1856* (2013.01)

(58) Field of Classification Search
CPC .. B41J 2/1721; B41J 2/185; B41J 2002/1856; B41J 2002/1742
See application file for complete search history.

(56) References Cited

U.S. PATENT DOCUMENTS 6,155,666 A * 12/2000 Sugimoto ..... B41J 2/1652 347/24
2005/0062794 A1* 3/2005 Kanamitsu ..... B41J 2/16523 347/31
2008/0158294 A1* 7/2008 Katoh ..... B41J 2/1721 347/36
2009/0256884 A1* 10/2009 Aoki ..... B41J 2/1721 347/23
2012/0234436 A1 9/2012 Harada et al.
2012/0236074 A1 9/2012 Harada et al.
2014/0168323 A1 6/2014 Ishida et al.

FOREIGN PATENT DOCUMENTS

JP 2003-011394 A 1/2003
JP 2012-196803 A 10/2012
JP 2014-117858 A 6/2014
JP 2015-063007 A 4/2015

* cited by examiner

*Primary Examiner* — Sharon A Polk
(74) *Attorney, Agent, or Firm* — Merchant & Gould P.C.

(57) ABSTRACT

A liquid consuming apparatus includes: a liquid consumer that consumes liquid; a liquid receiver that receives the liquid discharged from the liquid consumer; a first waste-liquid storage connected to the liquid receiver so as to allow communication of the liquid therebetween; a second waste-liquid storage connected to the first waste-liquid storage so as to allow communication of the liquid therebetween; a housing; and a sheet tray supported by the housing. The first waste-liquid storage is disposed on a side of the sheet tray. The second waste-liquid storage is disposed under the sheet tray.

16 Claims, 15 Drawing Sheets

LIQUID CONSUMING APPARATUS AND INK-JET PRINTER

CROSS REFERENCE TO RELATED APPLICATION

The present application claims priority from Japanese Patent Application No. 2015-214610, which was filed on Oct. 30, 2015, the disclosure of which is herein incorporated by reference in its entirety.

BACKGROUND

Technical Field

The following disclosure relates to a liquid consuming apparatus including a waste-liquid storage that stores liquid sucked from a liquid consumer and to an ink-jet printer.

Description of the Related Art

As one example of liquid consuming apparatuses, there are known ink-jet recording apparatuses including a recording head that ejects ink from ejection openings to record an image on a sheet.

One example of the well-known ink-jet recording apparatuses includes a waste ink storage divided into a fixed waste ink storage and a replaceable movable waste ink storage.

SUMMARY

Increased durability of an ink-jet recording apparatus has increased the number of printings that can be performed by the ink-jet recording apparatus. The increase in the number of available printings increases an amount of ink sucked from a recording head in operations such as maintenance. As a result, increase in capacity of a waste ink storage is required. However, the larger capacity of the waste ink storage unfortunately leads to increase in size of the ink-jet recording apparatus.

Accordingly, an aspect of the disclosure relates to a liquid consuming apparatus and an ink-jet printer including a waste-liquid (waste-ink) storage having an increased capacity, with efficient arrangement of components which reduces increase in size of the liquid consuming apparatus.

In one aspect of the disclosure, a liquid consuming apparatus includes: a liquid consumer that consumes liquid; a liquid receiver that receives the liquid discharged from the liquid consumer; a first waste-liquid storage connected to the liquid receiver so as to allow communication of the liquid therebetween; a second waste-liquid storage connected to the first waste-liquid storage so as to allow communication of the liquid therebetween; a housing; and a sheet tray supported by the housing. The first waste-liquid storage is disposed on a side of the sheet tray. The second waste-liquid storage is disposed under the sheet tray.

In the liquid consuming apparatus constructed as described above, efficient arrangement reduces increase in size of the liquid consuming apparatus with increased capacity of the waste-liquid storage.

In another aspect of the disclosure, an ink-jet printer includes: an ink-jet head; a first waste-ink storage; a second waste-ink storage; a first waste-ink path connected to the first waste-ink storage, the first waste-ink path being connectable to the ink-jet head, wherein the first waste-ink storage is communicated with the ink-jet head via the first waste-ink path when the first waste-ink path is connected to the ink-jet head; a second waste-ink path connected to the first waste-ink storage and the second waste-ink storage, wherein the second waste-ink storage is communicated with the ink-jet head via the first ink path and the second ink path when the first ink path is connected to the ink-jet head; a housing; and a sheet tray supported by the housing. The first waste-ink storage is disposed on a side of the sheet tray, and the second waste-ink storage is disposed under the sheet tray.

In still another aspect of the disclosure, an ink-jet printer includes: an ink-jet head; a first waste-ink storage; a second waste-ink storage connected to the first waste-ink storage; a waste-ink path having an inlet and an outlet, the outlet being connected to first ink storage, the inlet being connectable to the ink-jet head; a housing; and a sheet tray supported by the housing. The first waste-ink storage is disposed on a side of the sheet tray, and the second waste-ink storage is disposed under the sheet tray.

EFFECTS

Efficient arrangement reduces increase in size of the liquid consuming apparatus with increased capacity of the first waste-liquid storage and the second waste-liquid storage.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Figure 1:
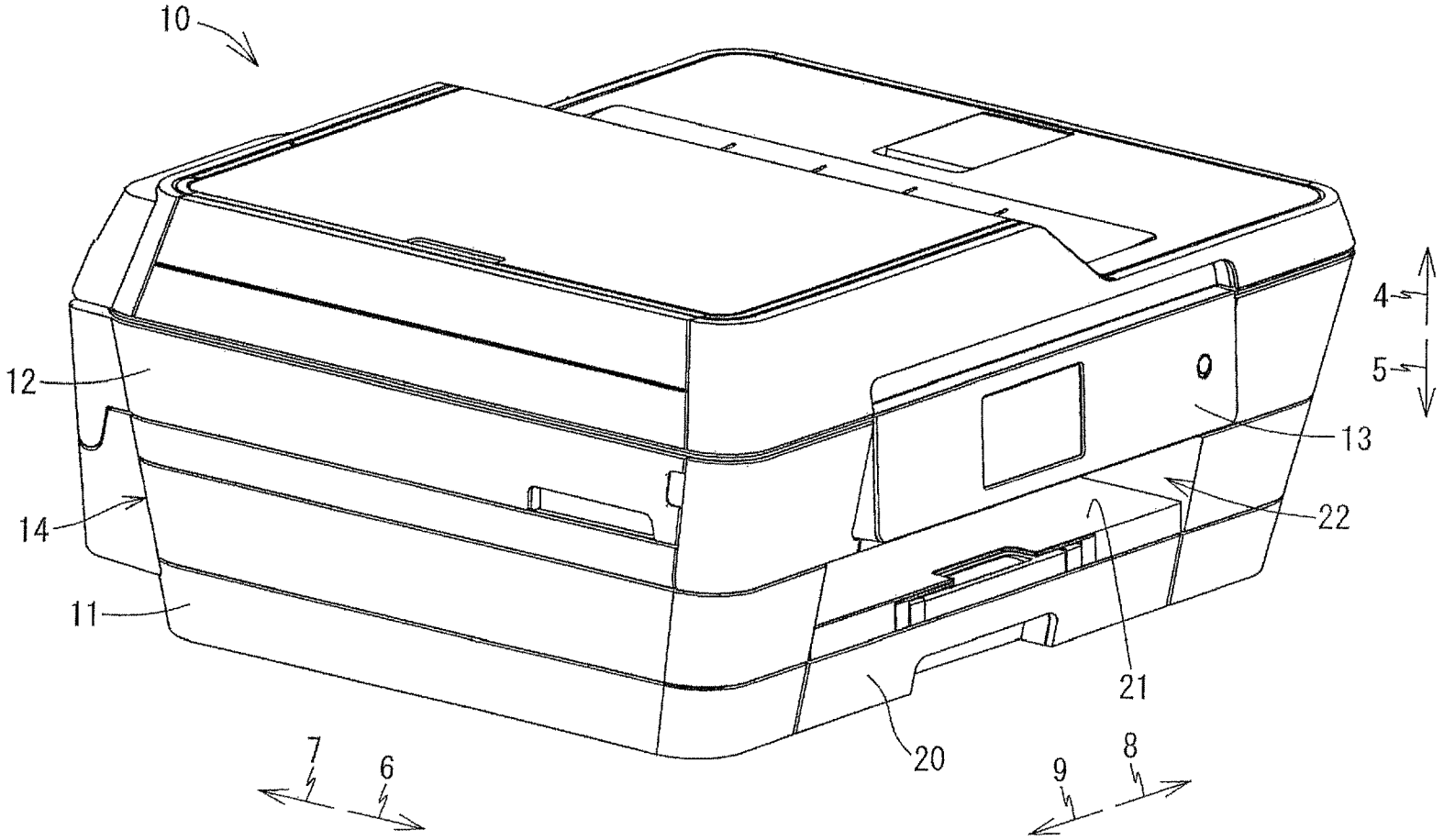
FIG. 1 is an external perspective view of a multi-function peripheral (MFP)

Hereinafter, there will be described one embodiment by reference to the drawings. It is to be understood that the following embodiment is described only by way of example, and the disclosure may be otherwise embodied with various modifications without departing from the scope and spirit of the disclosure. A multi-function peripheral (MFP) 10 is used in a state illustrated in FIG. 1. In the following description, up and down directions 4, 5 (the up and down direction) are defined in this state. Also, front and rear directions 6, 7 (the front and rear direction) are defined by regarding a surface of the MFP 10 which has an opening 22 as a front surface. Right and left directions 8, 9 (the right and left direction) are defined in a state in which the MFP 10 is viewed in the rear direction 7. The up and down directions 4, 5 are opposite each other. The front and rear directions 6, 7 are opposite each other. The right and left directions 8, 9 are opposite each other. The up direction 4, the front direction 6, and the right direction 8 are orthogonal to each other.

General Structure of MFP 10

The MFP 10 as one example of a liquid consuming apparatus and an ink-jet printer has various functions including a printing function and a scanning function. As illustrated in FIG. 1, the MFP 10 includes a printer housing 11 as one example of a housing and a scanner housing 12 disposed on the printer housing 11. The MFP 10 has a generally rectangular parallelepiped outer shape in its entirety. The front surface of the MFP 10 is provided with an operation panel 13 that includes various operation buttons and a liquid crystal display.

Figure 2:
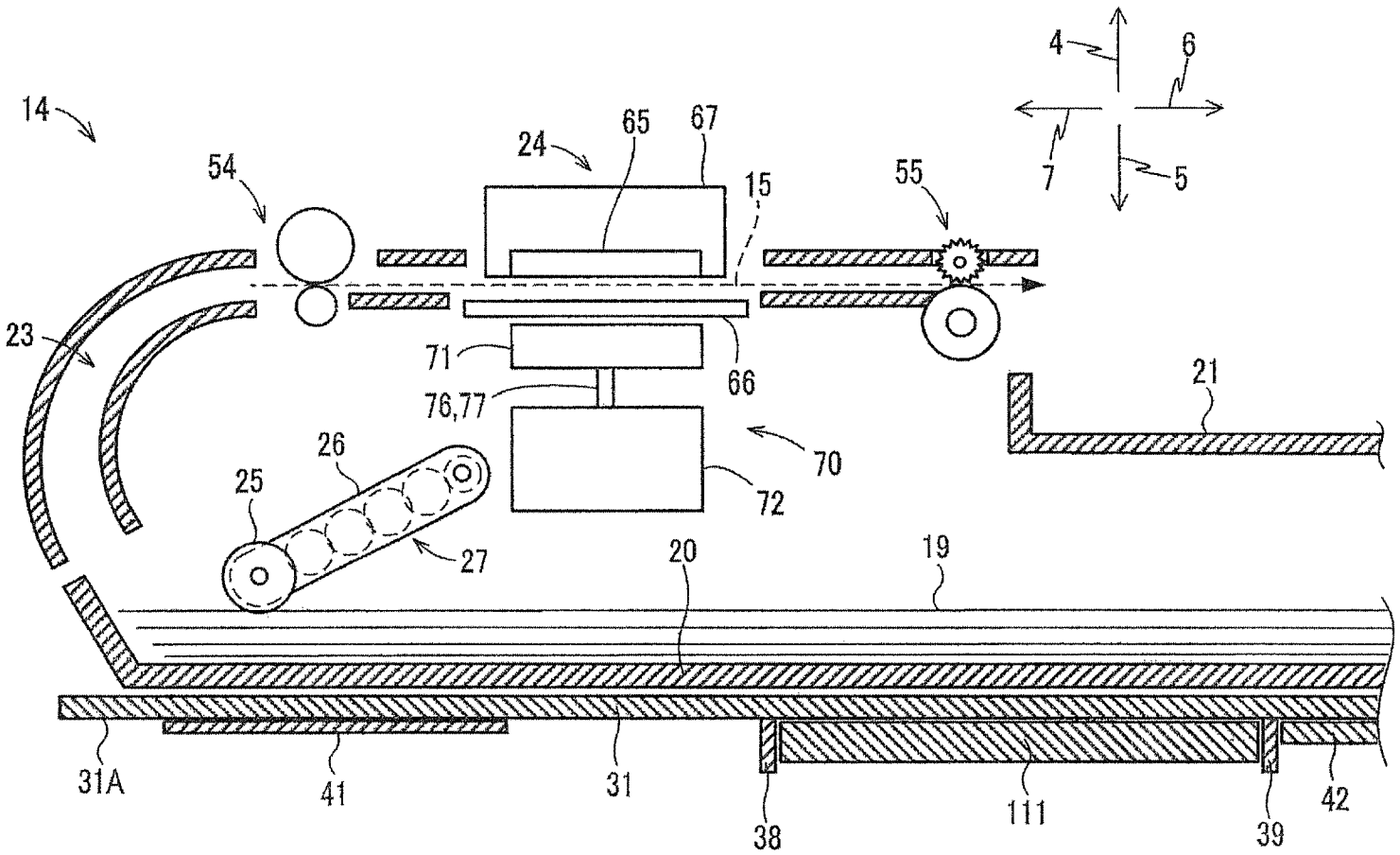
FIG. 2 is a schematic view illustrating an internal structure of a printer housing.

The printer housing 11 serves as outer walls of a printer 14 that records an image on a recording sheet 19 as one example of a sheet. As illustrated in FIG. 2, the printer 14 records an image on the recording sheet 19 conveyed from a supply tray 20 (as one example of a sheet tray) and discharges the image-recorded sheet 19 onto a discharge tray 21. The supply tray 20 and the discharge tray 21 are mountable on and removable from the printer housing 11 through the opening 22 formed in the front surface of the printer housing 11. The scanner housing 12 serves as outer walls of an image reader including a flatbed scanner. A well-known image reader is employed as the image reader, and detailed description and illustration of which are dispensed with.

Printer 14

As illustrated in FIG. 2, a supply roller 25 as one example of a roller is disposed on an upper side of the supply tray 20. The supply roller 25 is rotatably supported by a supply arm 26. The supply roller 25 moves in the up and down directions 4, 5 in accordance with change of the thickness of the recording sheets 19 stacked on the supply tray 20. This movement of the supply roller 25 causes pivotal movement of the supply arm 26. The supply roller 25 is rotated by rotation of a motor, not illustrated, which is transmitted by a drive-power transmitting mechanism 27 such as a gear train. The supply roller 25 is rotated while being in contact with an uppermost one of the recording sheets 19 supported on the supply tray 20. This rotation supplies the uppermost recording sheet 19 to a conveyance path 23.

The conveyance path 23 is curved upward and frontward from a rear end portion of the supply tray 20 and extends in the front direction 6 substantially in a straight line toward the discharge tray 21. The conveyance path 23 is located at a substantially central area in the printer housing 11 in the right and left directions 8, 9. A conveying roller pair 54 and a discharge roller pair 55 are provided on the conveyance path 23. The recording sheet 19 nipped by the conveying roller pair 54 and the discharge roller pair 55 is conveyed on the conveyance path 23 in a conveying direction 15. The recording sheet 19 supplied from the supply tray 20 is conveyed by at least one of the conveying roller pair 54 and the discharge roller pair 55 so as to make an upward U-turn along the conveyance path 23. When the recording sheet 19 reaches a position just under an image recorder 24 as one example of a liquid consumer, the image recorder 24 records an image. The recording sheet 19 is then discharged onto the discharge tray 21.

The image recorder 24 is an ink-jet recording device. The image recorder 24 includes a recording head 65 as one example of an ink-jet head and a carriage 67. The carriage 67 is located above the conveyance path 23. The carriage 67 is moved along guide rails, not illustrated, in the right and left directions 8, 9 by receiving power of a motor, not illustrated, which is transmitted by a belt driving mechanism, not illustrated. The recording head 65 is mounted on the carriage 67. A platen 66 is disposed under the recording head 65. The platen 66 extends over an area on which the carriage 67 is moved, in other words, the platen 66 extends over the entire area of the conveyance path 23 in the right and left directions 8, 9. The platen 66 supports a lower surface of the recording sheet 19 conveyed along the conveyance path 23. The recording head 65 is opposed to the platen 66. During movement of the carriage 67 in the right and left directions 8, 9, the recording head 65 selectively ejects ink (as one example of liquid) onto the recording sheet 19 supported on the platen 66, to record an image on the recording sheet 19.

Figure 3:
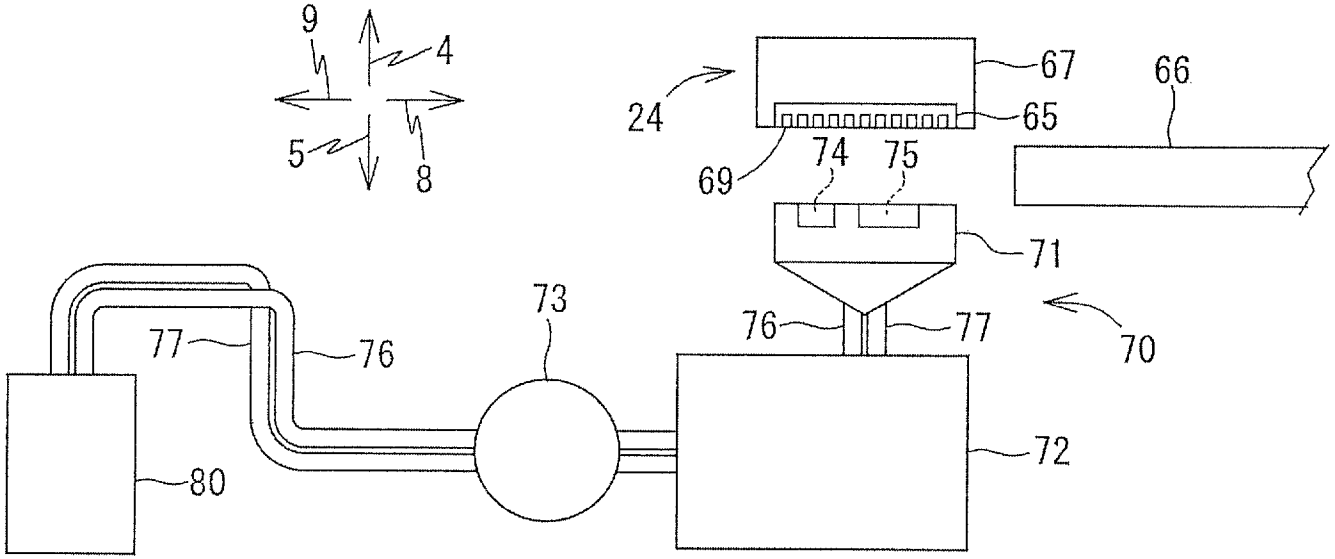
FIG. 3 is a schematic view illustrating constructions of a purging mechanism and a first waste-liquid tank.

As illustrated in FIG. 3, a lower surface of the recording head 65 has a multiplicity of nozzles 69. The nozzles 69 are arranged in four rows each extending in the conveying direction 15. The rows respectively correspond to four colors of ink, namely, cyan, magenta, yellow, and black, for example. Though not illustrated, the recording head 65 is connected to ink cartridges so as to allow ink flow therebetween. The ink cartridges store the ink of the respective four colors. The ink of the four colors is supplied to the recording head 65 from the respective ink cartridges.

Lower Cover 30

Figure 4:
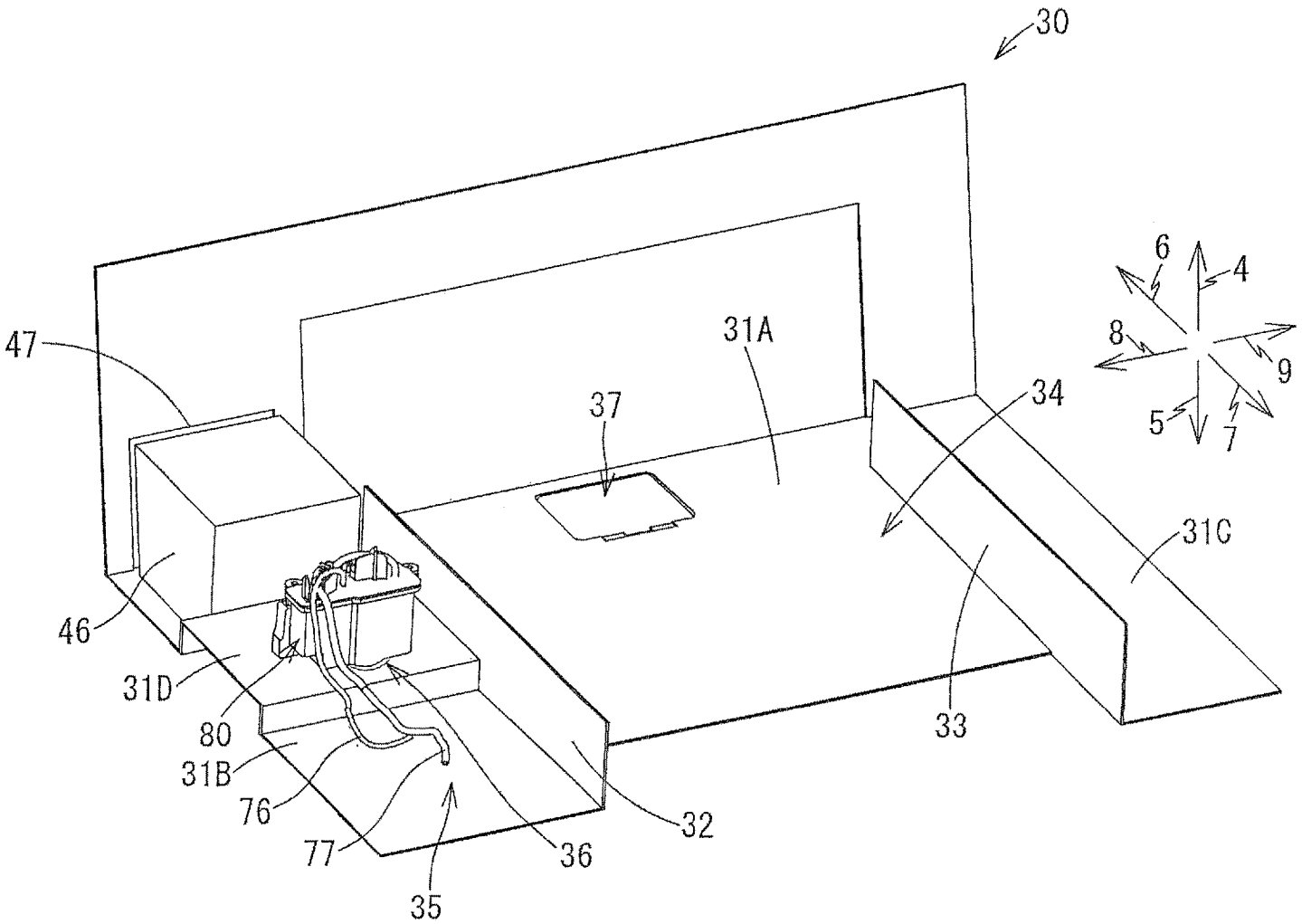
FIG. 4 is a perspective view illustrating a construction of a lower cover.

As illustrated in FIG. 4, the printer housing 11 includes a lower cover 30 that principally serves as a portion of the front surface of the MFP 10 and a lower surface of the MFP 10. Though not illustrated, the printer housing 11 includes an upper cover principally serving as side surfaces and a rear surface of the MFP, and this upper cover is assembled to an upper portion of the lower cover 30 to form the printer housing 11.

The lower cover 30 includes: bottom boards 31A, 31B, 31C constituting the lower surface of the MFP 10; and a right wall 32 and a left wall 33 which define a space 34 in which the supply tray 20 is to be mounted. The right wall 32 and the left wall 33 protrude upward from the lower surface and extend in the front and rear directions 6, 7 so as to be parallel with each other. The bottom board 31A is located at a central portion of the lower cover 30 in the right and left directions 8, 9. The bottom board 31B is located at a right end portion of the lower cover 30 in the right and left directions 8, 9. The bottom board 31C is located at a left end portion of the lower cover 30 in the right and left directions 8, 9. The bottom board 31B protrudes in the up direction 4 at its portion located slightly in front of the center of the bottom board 31B in the front and rear directions 6, 7. The reference numeral 31D in FIG. 4 denotes this protruding portion which will be hereinafter referred to as "bottom board 31D". The bottom board 31D is located above the bottom board 31B.

The space 34 is located at a central portion of the lower cover 30 in the right and left directions 8, 9 and defined by the bottom board 31A, the right wall 32, and the left wall 33 so as to extend in the front and rear directions 6, 7. A space 35 is formed over the bottom board 31B and the bottom board 31D and to the right of the right wall 32. A refill casing 46, a purging mechanism 70, and a first waste-liquid tank 80 (as one example of a third waste-liquid storage) are provided in the space 35.

The refill casing 46 is provided in a front portion of the space 35. The refill casing 46 is shaped like a box having an opening in its front surface. The refill casing 46 is capable of holding the ink cartridges, not illustrated, storing the ink of the four colors which is to be supplied to the recording head 65. Though not illustrated, a plurality of tubes respectively corresponding to the four colors of the ink extend to the recording head 65 from the refill casing 46 on which the ink cartridges are mounted. The ink is supplied from the ink cartridges to the recording head 65 through the respective tubes. An opening is formed in a front surface of the refill casing 46. The ink cartridges are inserted into and removed from the refill casing 46 though an opening 47 formed in the lower cover 30 and an opening formed in the front surface of the MFP 10.

It is noted that a purging mechanism 70 is disposed in a rear portion of the space 35 but is not illustrated in FIG. 4. The first waste-liquid tank 80 is located between the refill casing 46 and the purging mechanism 70 at a substantially central position of the space 35 in the front and rear directions 6, 7.

Figure 14:
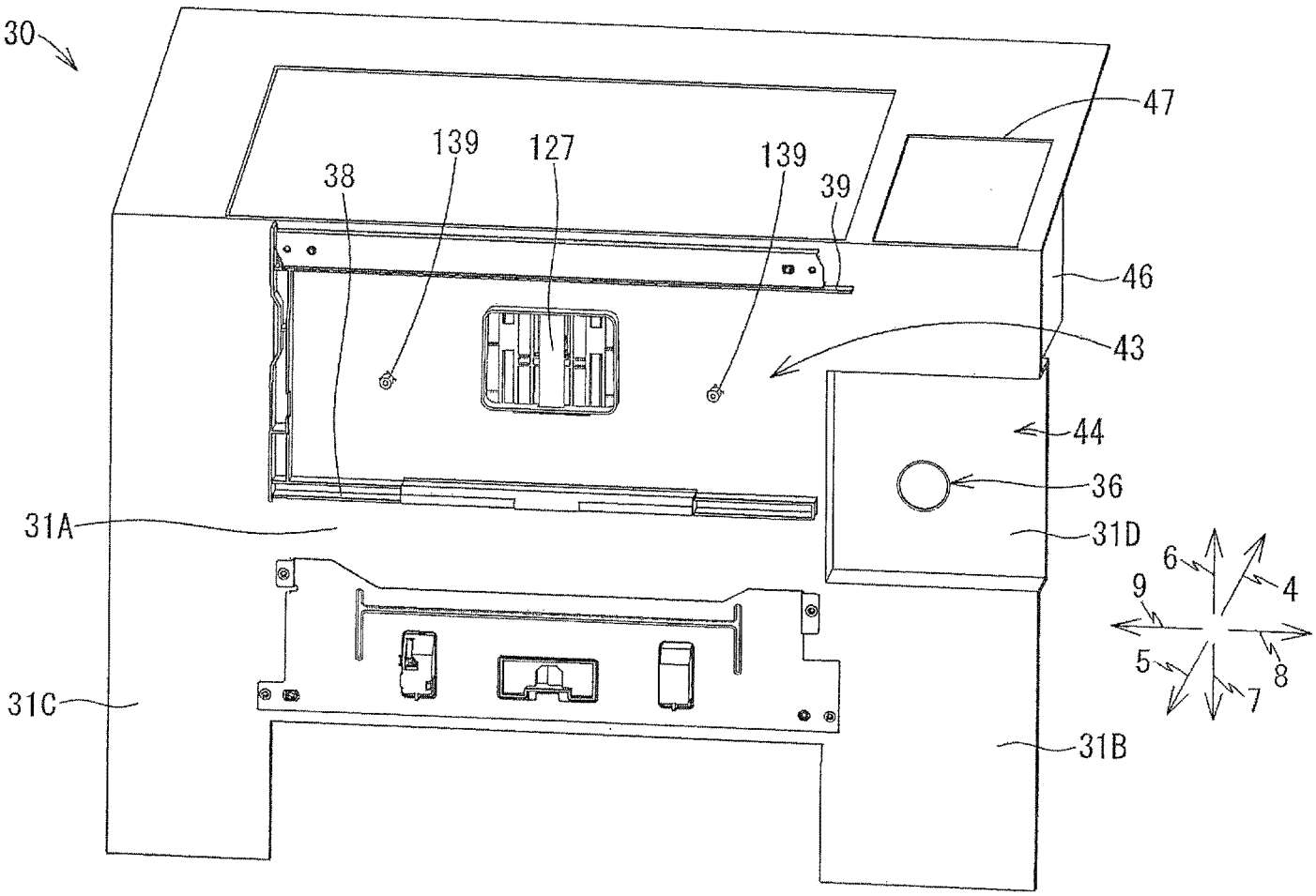
FIG. 14 is a perspective view of the lower cover viewed from the bottom.

As illustrated in FIG. 14, the lower cover 30 is provided with ribs 38, 39 protruding in the down direction 5 from a lower surface of the bottom board 31A and extending in the right and left directions 8, 9. The ribs 38, 39 are spaced apart from each other in the front and rear directions 6, 7. The ribs 38, 39 extend in the right and left directions 8, 9 just under the space 34. The ribs 38, 39 increase the flexural rigidity of the bottom board 31A in the right and left directions 8, 9 which is located between the right wall 32 and the left wall 33.

A first reinforcement 41 is provided at a rear of the rib 38 and under the bottom board 31A. The first reinforcement 41 is shaped like a partly-curved generally flat steel plate. The first reinforcement 41 is secured to the lower cover 30 by, e.g., screws while being in contact with the bottom board 31A. The longitudinal direction of the first reinforcement 41 coincides with the right and left directions 8, 9. The first reinforcement 41 reinforces an end portion of the bottom board 31A in the rear direction 7 (a rear end portion of the bottom board 31A) from a lower side thereof. The bottom board 31A supports the supply tray 20, and a pressing force is applied from the supply roller 25 to the rear end portion of the supply tray 20. Specifically, when the supply roller 25 is rotated in a direction in which the recording sheet 19 is to be supplied, the supply arm 26 is pivoted in the clockwise direction FIG. 2 in reaction to the rotation of the supply roller 25. The pivotal movement of the supply arm 26 in the clockwise direction causes the supply roller 25 to further press the recording sheet(s) 19 supported on the supply tray 20 in the down direction 5. Such a pressing force of the supply roller 25 is transmitted to the bottom board 31A via the supply tray 20. The first reinforcement 41 reinforces the bottom board 31A from a lower side thereof so as to reduce such a load acting on the rear end portion of the bottom board 31A.

A second reinforcement 42 extending in the right and left directions 8, 9 is provided in front of the rib 39 and under the bottom board 31A. The second reinforcement 42 is an elongated steel plate which is bent in a C-shape in cross section. The second reinforcement 42 is secured to the lower cover 30 by, e.g., screws while being in contact with the bottom board 31A in a state in which an opening of the C-shape in cross section faces in the up direction 4 or the down direction 5, and the longitudinal direction of the second reinforcement 42 coincides with the right and left directions 8, 9. The second reinforcement 42 reinforces an end portion of the bottom board 31A in the front direction 6 (a front end portion of the bottom board 31A) from a lower side thereof. The bottom board 31A supports the supply tray 20 and receives a relatively large load when the supply tray 20 is supported by the bottom board 31A in a state in which the supply tray 20 supporting a large number of the recording sheets 19 has been pulled out frontward or in a state in which a front portion of the supply tray 20 is extended in the front direction 6 so as to protrude from the front surface of the MFP 10 in the front direction 6 for storage of large-size sheets, for example. The second reinforcement 42 reinforces the bottom board 31A from a lower side thereof so as to reduce such a load acting on the front end portion of the bottom board 31A.

A second waste-liquid tank 110 is disposed under the lower cover 30. That is, the first waste-liquid tank 80 is located on an upper side of the second waste-liquid tank 110. A first body 111 of the second waste-liquid tank 110 is provided in a space 43 defined by the ribs 38, 39 and the bottom board 31A. A second body 112 of the second waste-liquid tank 110 is provided in a space 44 located under the bottom board 31D. Since the lower surface of the bottom board 31A is located below a lower surface of the bottom board 31D, the dimension of the space 43 in the up and down directions 4, 5, i.e., the height of the space 43, is less than that of the space 44 in the up and down directions 4, 5, i.e., the height of the space 44 in a state in which the lower cover 30 is placed on a surface such as a top of a desk.

Purging Mechanism 70

As illustrated in FIG. 3, the purging mechanism 70 is disposed in the space 35 at a position located under a path of movement of the recording head 65 and to the right of a right end of the platen 66. The purging mechanism 70 sucks the ink from the nozzles 69 of the recording head 65 and discharges the sucked ink to the first waste-liquid tank 80. The ink discharged from the nozzles 69 by the purging mechanism 70 will be hereinafter referred to as "waste ink". It is noted that FIG. 3 schematically illustrates the first waste-liquid tank 80 to indicate that the purging mechanism 70 and the first waste-liquid tank 80 are connected to each other by tubes 76, 77, but illustration in FIG. 3 does not indicate a positional relationship between the first waste-liquid tank 80 and the other components.

The purging mechanism 70 includes: a movable member 71; a cam mechanism 72 for moving the movable member 71 in the up and down directions 4, 5; the tubes 76, 77; and a pump 73. The movable member 71 includes caps 74, 75 (each as one example of a liquid receiver) formed of rubber. The caps 74, 75 are opposed to the lower surface of the recording head 65 in the up and down directions 4, 5 in a state in which the carriage 67 is located over the movable member 71. The cam mechanism 72 is operated by power transmitted from a motor, not illustrated, to move the movable member 71 in the up and down directions 4, 5. When the movable member 71 is moved upward, the caps 74, 75 are brought into contact with the lower surface of the recording head 65. In this state, the cap 74 covers the row of the nozzles 69 for ejecting the black ink, and the cap 75 covers the rows of the nozzles 69 for ejecting the cyan, magenta, and yellow ink. One ends of the respective tubes 76, 77 are connected to the caps 74, 75. Each of the tubes 76, 77 is a flexible tube formed of resin.

The pump 73 is a rotary tube pump which is operated by power transmitted from a motor, not illustrated, for example. The tubes 76, 77 establish communication of the pump 73 with a closed space that is formed between the lower surface of the recording head 65 and the caps 74, 75. When the pump 73 is driven in the state in which the nozzles 69 are covered with the caps 74, 75, a negative pressure is generated in the caps 74, 75, so that the ink discharged from the nozzles 69 is received by the caps 74, 75. The waste ink received by the caps 74, 75 flows to the first waste-liquid tank 80 by the pump 73 through the tubes 76, 77. The waste ink principally flows in the tube 76, and an atmosphere principally flows in the tube 77.

First Waste-Liquid Tank 80

As illustrated in FIG. 4, the first waste-liquid tank 80 is provided in the space 35 located on the lower cover 30. Though not illustrated, the purging mechanism 70 is located at a rear of the first waste-liquid tank 80. The tubes 76, 77 connected to the purging mechanism 70 extend in the front direction 6 so as to be connected to the first waste-liquid tank 80. A through hole 36 is formed in the bottom board 31D of the lower cover 30 which is located under the space 35. A cylindrical portion 87 of the first waste-liquid tank 80 is inserted in the through hole 36 and secured to the lower cover 30 by a screw, not illustrated.

Figure 5:
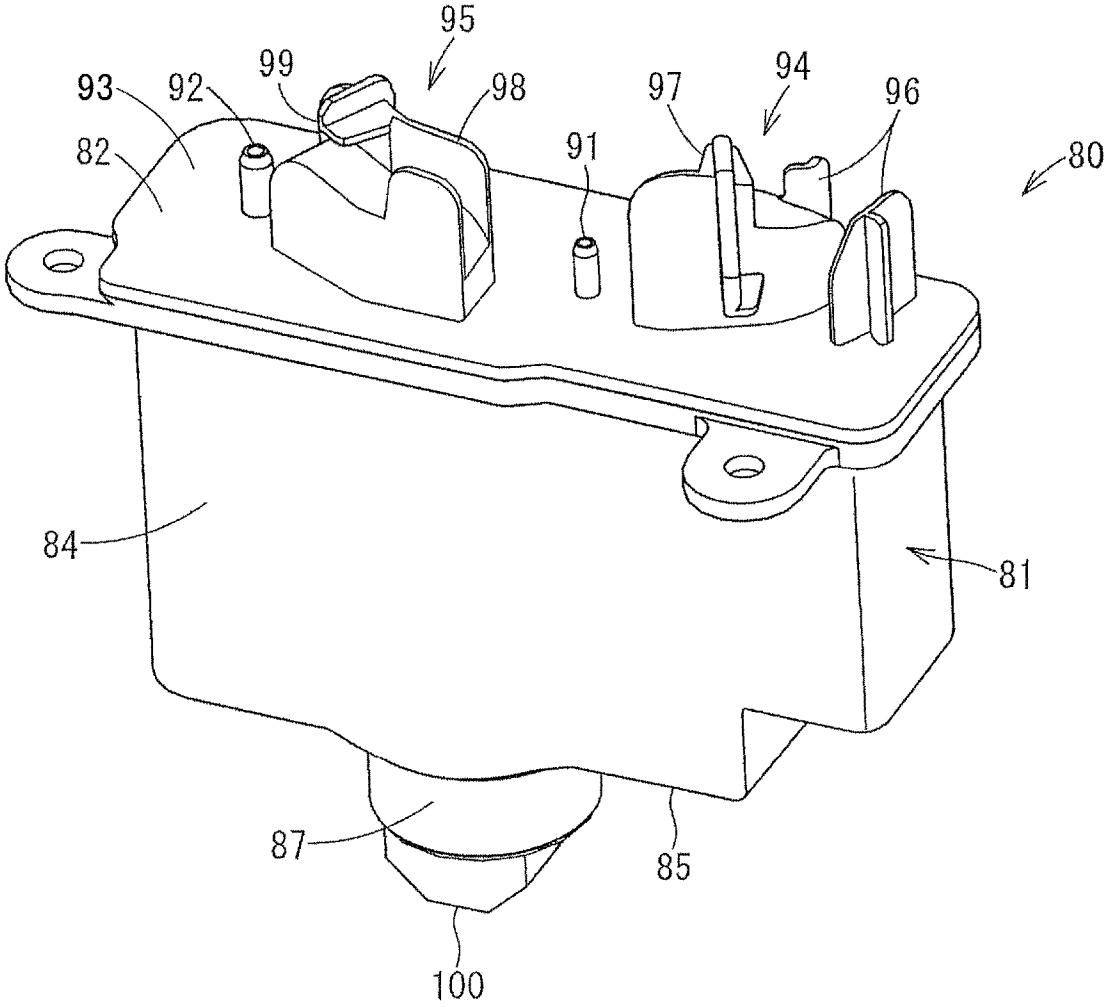
FIG. 5 is an external perspective view of the first waste-liquid tank.
Figure 6:
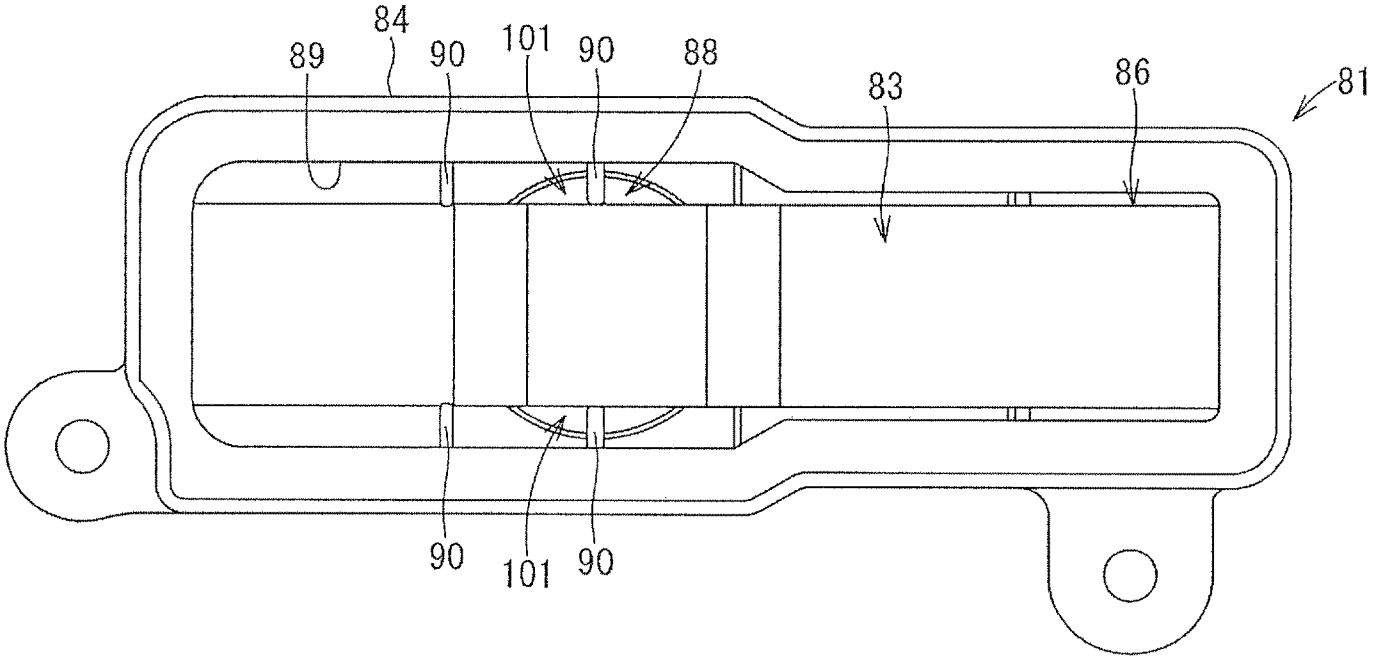
FIG. 6 is a plan view of a body and an ink absorber.
Figure 7:
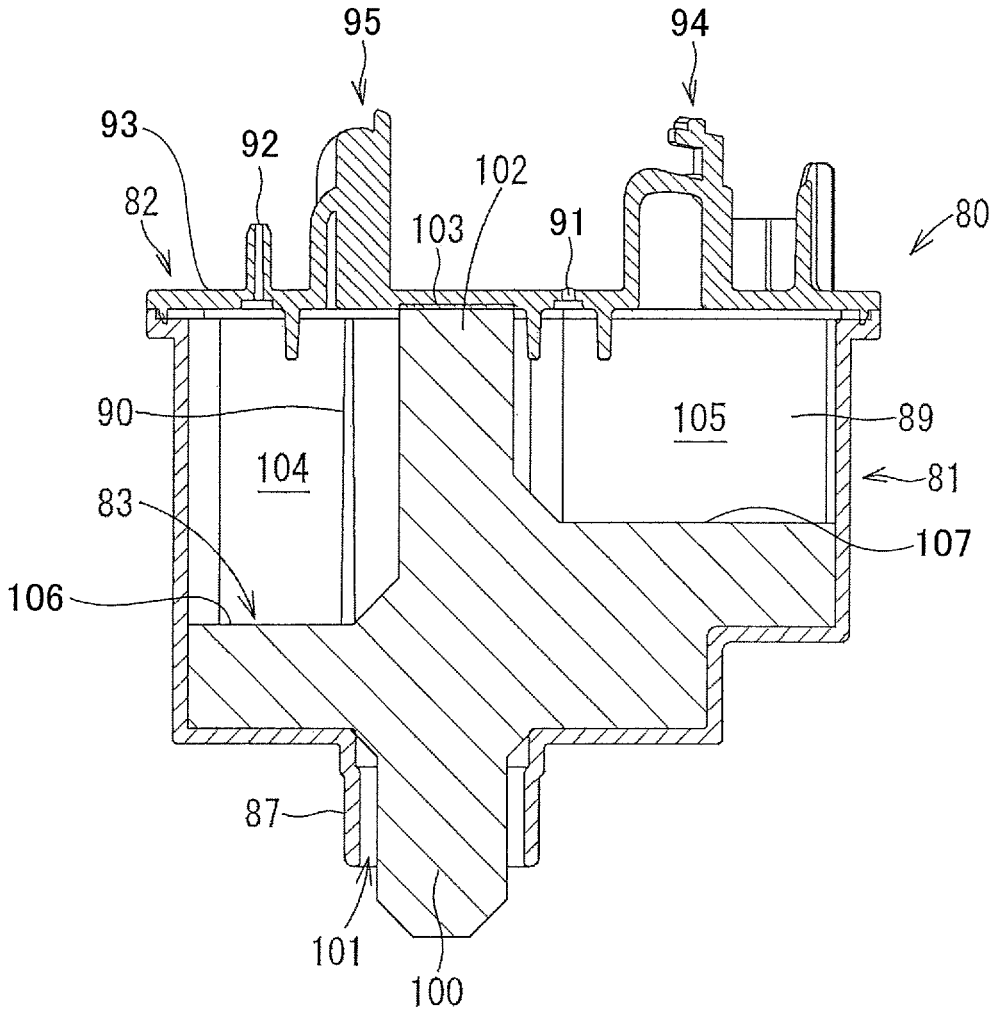
FIG. 7 is an elevational view in vertical cross section illustrating the first waste-liquid tank.

As illustrated in FIGS. 5-7, the first waste-liquid tank 80 includes a body 81, the lid 82, and an ink absorber 83 as one example of a liquid absorber. The body 81 and the lid 82 are one example of a first housing. Also, the caps 74, 75, the tubes 76, 77, the pump 73, and the ink absorber 83 are one example of a first waste-ink path.

As illustrated in FIG. 6, the body 81 is shaped like a hollow box including a side wall 84 and a bottom board 85. The body 81 has an opening 86 on its upper side. The opening 86 is rectangular in plan view and defined by an upper end of the side wall 84 shaped like a quadrangular prism. The cylindrical portion 87 extends in the down direction 5 from the bottom board 85 of the body 81. The cylindrical portion 87 is hollow and has an opening 88 in its lower end. Spaces inside and outside the body 81 communicate with each other through the cylindrical portion 87. The cylindrical portion 87 is located at a substantially center of the long sides of the rectangular shape of the bottom board 85 in the right and left directions 8, 9.

Four ribs 90 protrude from a side surface 89 as an inner surface of the side wall 84 which defines an inner space of the body 81. Each of the ribs 90 is provided on a corresponding side of the opening 88 formed in the cylindrical portion 87. Specifically, the ribs 90 are provided in front of and at a rear of the opening 88. The ribs 90 protrude inwardly from the side surface 87 and extend in the up and down directions 4, 5. Lower ends of the respective ribs 90 are continuous to the bottom board 85. Protruding ends of the respective ribs 90 contact the ink absorber 83 provided in the space defined in the body 81.

As illustrated in FIGS. 5 and 7, the opening 86 formed in the body 81 is sealed with the lid 82. The lid 82 is provided with port defining members 91, 92 to which the respective tubes 76, 77 are connected. It is noted that each of openings defined by portions of the respective tubes 76, 77 to which the respective port defining members 91, 92 are connected is one example of an outlet. Each of the port defining members 91, 92 is shaped like a pipe having a round shape in cross section. The port defining members 91, 92 protrude upward from the lid 82. Each of the port defining members 91, 92 has an inner space that extends through the lid 82. The inner spaces of the respective port defining members 91, 92 establish communication between the inner space of the body 81 and the outside. The port defining members 91, 92 are spaced apart from each other in plan view in the direction of the long sides of the rectangular shape of the lid 82. The port defining member 92 is nearer to an end of the body 81 than the ribs 90 in the direction of the long sides of the lid 82, i.e., in the right and left directions 8, 9 established in a state in which the first waste-liquid tank 80 is disposed on the lower cover 30. Each of the inner spaces of the respective port defining members 91, 92 is one example of a port.

Tube supporters 94, 95 are provided on an upper surface 93 of the lid 82. The tube supporter 94 supports the tube 76 connected to the port defining member 91. The tube supporter 95 supports the tube 77 connected to the port defining member 92. The tube supporter 94 includes: a nip portion 96 that nips the tube 76 in the horizontal direction; and a holding portion 97 that inhibits movement of the tube 76 in the up direction 4.

Figure 11:
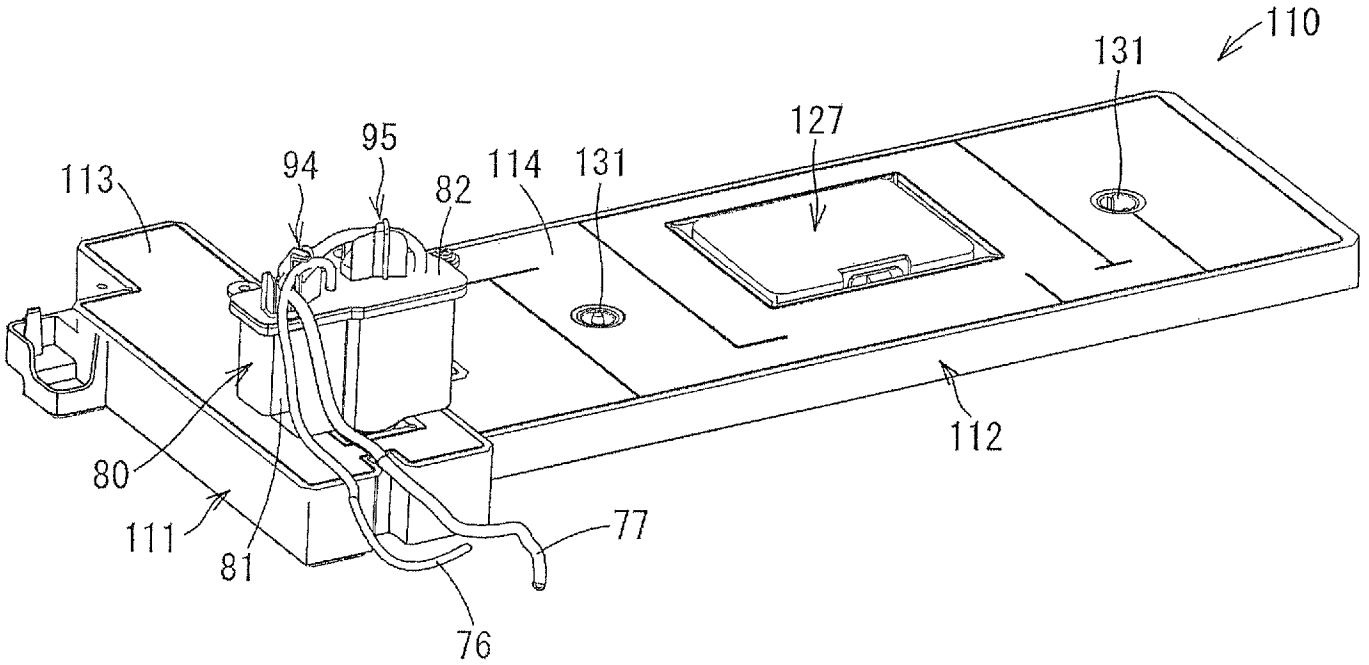
FIG. 11 is a perspective view of the first waste-liquid tank and the second waste-liquid tank.

As illustrated in FIGS. 4 and 11, the tube 76 first extends from the port defining member 91 in the up direction 4 and contacts the holding portion 97 which inhibits the extension of the tube 76 in the up direction 4, so that the tube 76 is curved so as to extend in the down direction 5. The tube 76 is nipped by the nip portion 96 in the state in which the tube 76 is curved in the down direction 5. This nip inhibits movement of the tube 76 in the front and rear directions 6, 7 and in the right and left directions 8, 9. The tube supporter 95 includes: a nip portion 98 that nips the tube 77 in the horizontal direction; and a holding portion 99 that inhibits movement of the tube 77 in the up direction 4. The tube 77 first extends from the port defining member 92 in the up direction 4 and contacts the holding portion 99 which inhibits the extension of the tube 77 in the up direction 4, so that the tube 77 is curved so as to extend in the down direction 5. The tube 77 is nipped by the nip portion 98 in the state in which the tube 77 is curved in the down direction 5. This nip inhibits movement of the tube 77 in the front and rear directions 6, 7 and in the right and left directions 8, 9.

When the first waste-liquid tank 80 is disposed on the lower cover 30 in the state in which the tubes 76, 77 are supported by the respective tube supporters 94, 95, an uppermost portion of each of the tubes 76, 77 is located below the caps 74, 75 positioned when the movable member 71 of the purging mechanism 70 is located at its lowermost position.

As illustrated in FIG. 7, the ink absorber 83 is provided in the inner space of the body 81, with the opening 86 sealed with the lid 82. The ink absorber 83 is formed of a fabric material and constituted by a felt component, for example. The waste ink having flowed into the inner space of the body 81 is absorbed and retained by the ink absorber 83.

The ink absorber 83 extends in the body 81 so as to cover substantially the entirety of the bottom board 85. A most portion of the ink absorber 83 is disposed in a lower portion of the inner space of the body 81. Spaces are formed in some areas between the ink absorber 83 and the lid 82.

The ink absorber 83 includes a first protrusion 100 protruding in the down direction 5. The first protrusion 100 has a generally quadrangular prism shape. The first protrusion 100 is inserted in an inner space of the cylindrical portion 87 of the body 81. A lower end portion of the first protrusion 100 protrudes from the opening 88 of the cylindrical portion 87 to the outside of the body 81. That is, a lower end of the ink absorber 83 is located below a lower end of the body 81 and exposed to the outside of the body 81. The inner space of the cylindrical portion 87 has a round shape in plan view, and the first protrusion 100 has a quadrangle shape in horizontal cross section. Thus, a space 101 is formed between the cylindrical portion 87 and the first protrusion 100.

The ink absorber 83 has a second protrusion 102 protruding upward. The second protrusion 102 has a generally quadrangular prism shape. The second protrusion 102 is located substantially just above the first protrusion 100. In the inner space of the body 81, an upper surface 103 of the second protrusion 102 is in contact with the lid 82. The upper surface 103 of the second protrusion 102 is in contact with a portion of the lid 82 which is located between the port defining member 91 and the port defining member 92. The ink absorber 83 is not in contact with the lid 82 at its portion other than the upper surface 103 of the second protrusion 102. Thus, the second protrusion 102 partitions the inner space of the body 81 into (i) a space 104 communicating with the port defining member 91 and (ii) a space 105 communicating with the port defining member 92. An upper surface 106 of the ink absorber 83 which defines the space 104 is located below an upper surface 107 of the ink absorber 83 which defines the space 105. It is noted that the space 104 and the space 105 are not necessarily separated from each other completely.

Second Waste-liquid Tank 110

Figure 8:
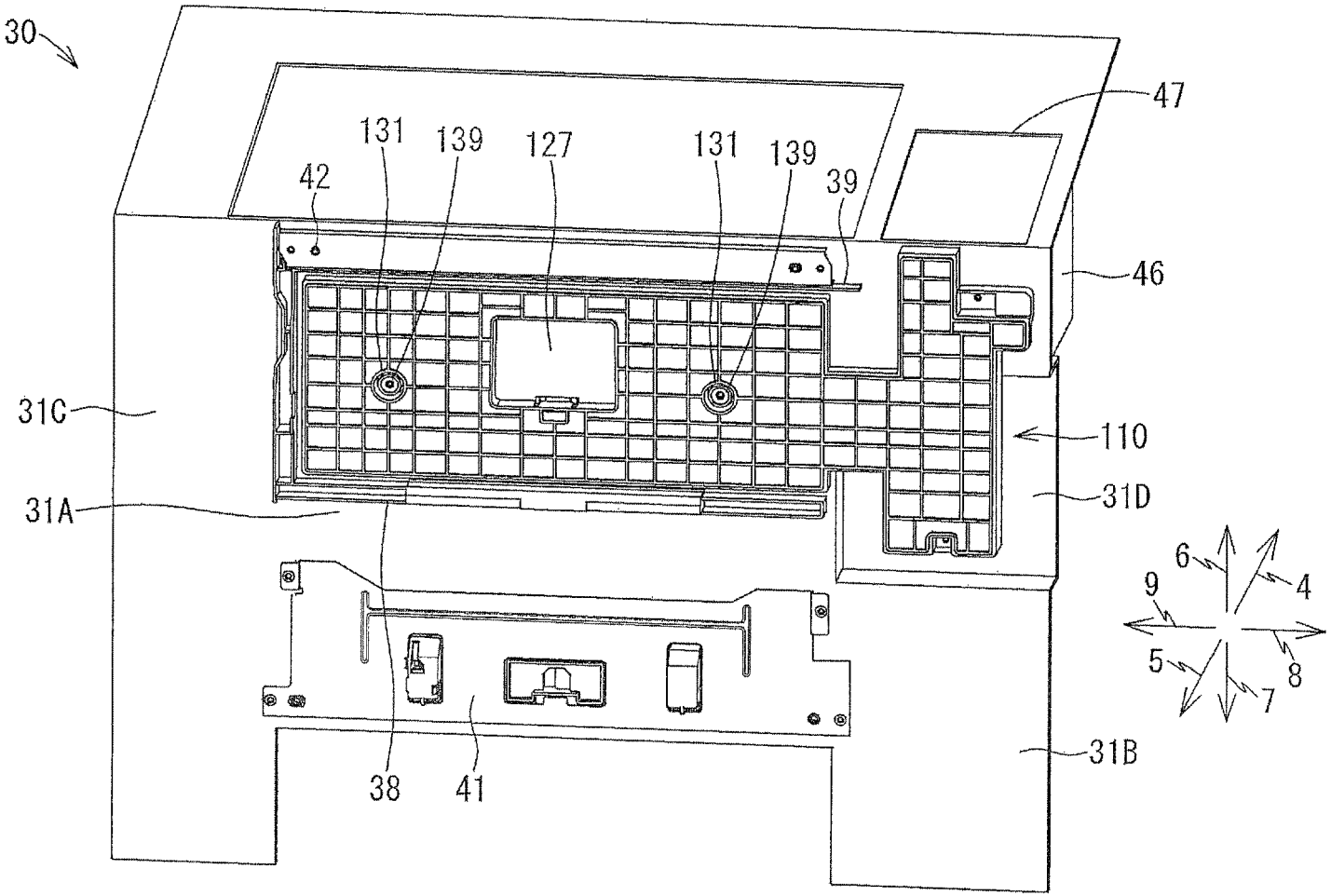
FIG. 8 is a perspective view of the lower cover and a second waste-liquid tank viewed from the bottom.

As illustrated in FIG. 8, the second waste-liquid tank 110 is disposed under the bottom board 85 of the lower cover 30. Though not illustrated, the cylindrical portion 87 of the first waste-liquid tank 80 disposed on the bottom board 31D of the lower cover 30 protrudes in the down direction 5 from the bottom board 31D through the through hole 36 formed through the bottom board 31D.

Figure 9:
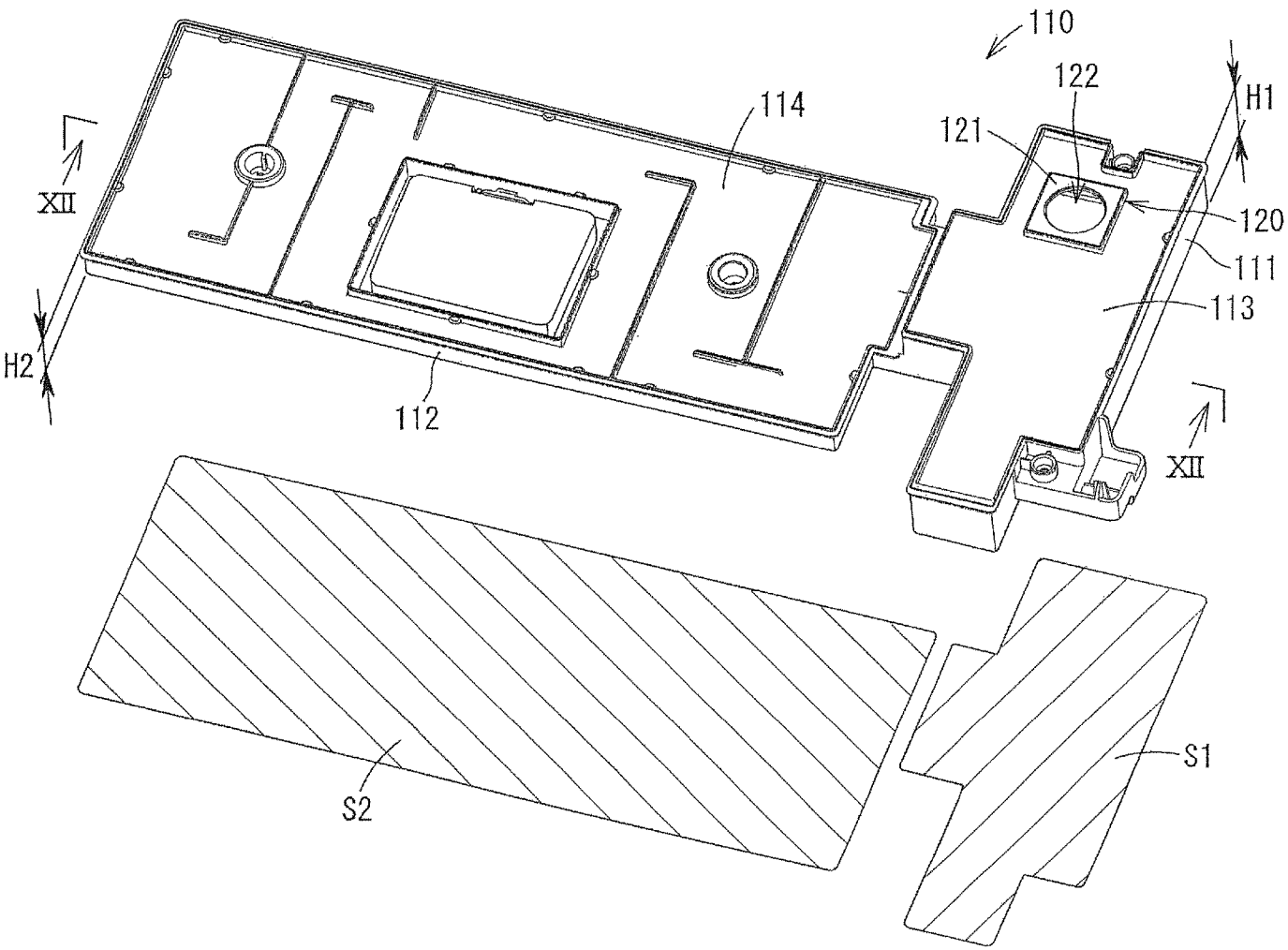
FIG. 9 is a perspective view of the second waste-liquid tank.
Figure 10:
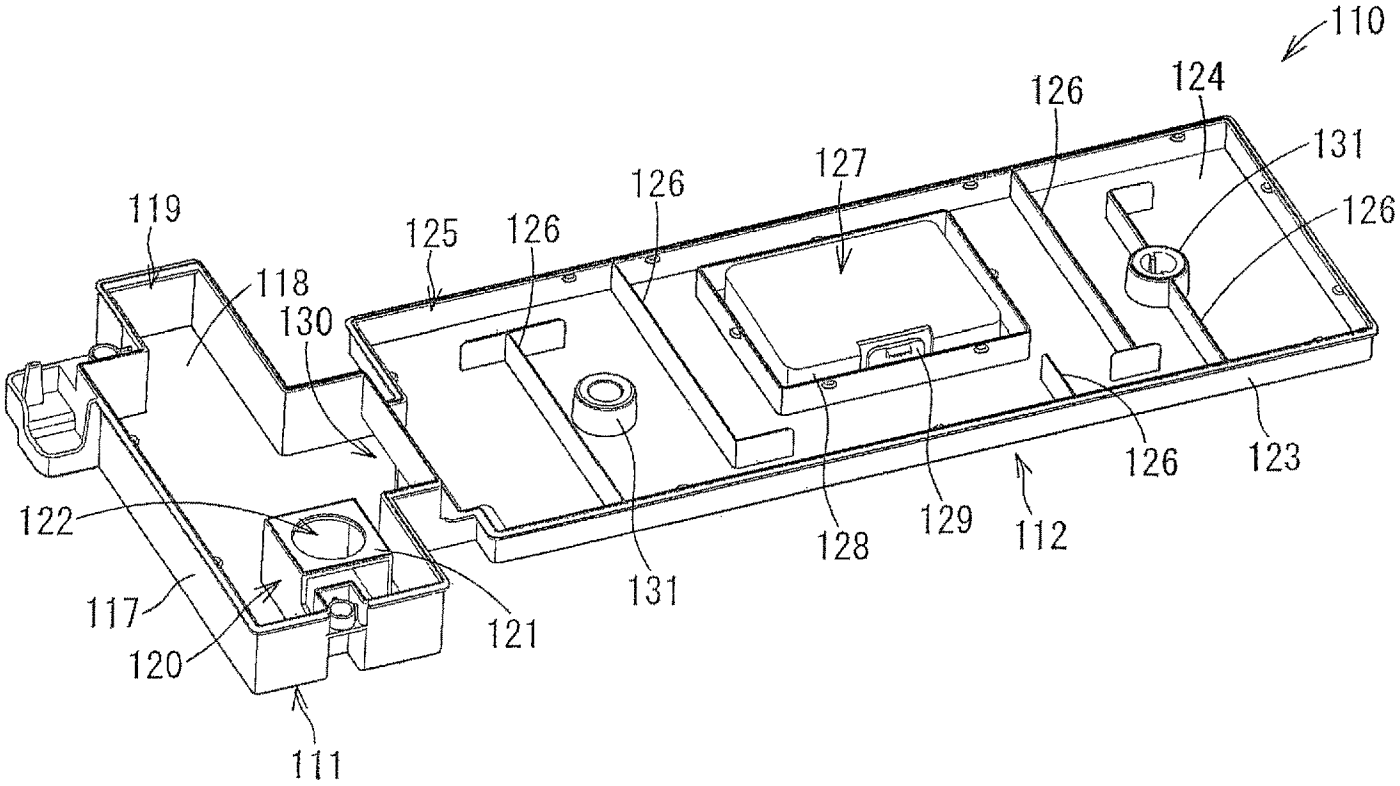
FIG. 10 is a perspective view of a first body and a second body.

As illustrated in FIGS. 9-11, the second waste-liquid tank 110 includes the first body 111, the second body 112, sheets 113, 114, and ink absorbers 115, 116 (each one example of a liquid absorber). Each of the first body 111, the sheet 113, and the ink absorber 115 is one example of a first waste-liquid storage and a first waste-ink storage. The capacity of the second waste-liquid tank 110 for storage of the waste ink is greater than that of the first waste-liquid tank 80 for storage of the waste ink. Each of the second body 112, the sheet 114, and the ink absorber 116 is one example of a second waste-liquid storage and a second waste-ink storage.

As illustrated in FIG. 10, the first body 111 is a hollow box having a side wall 117 and a bottom board 118. The first body 111 opens upward and has an opening 119. The first body 111 is thin and flat and has a generally rectangular parallelepiped shape as an outer shape. The opening 119 is defined by an upper end of the side wall 117. A projection 120 protruding in the up direction 4 is provided on the bottom board 118 of the first body 111. The projection 120 is hollow and opens in its front and rear portions. An opening 122 is formed in a top board 121 of the projection 120. The opening 119 of the first body 111 is closed by the sheet 113 except for the opening 122 formed in the top board 121 of the projection 120.

The second body 112 is a hollow box having a side wall 123 and a bottom board 124. The second body 112 opens upward and has an opening 125. The second body 112 is thin and flat and has a generally rectangular parallelepiped shape as an outer shape. The opening 125 is defined by an upper end of the side wall 123. A plurality of ribs 126 are provided on the second body 112. The ribs 126 protrude from the bottom board 124 in the up direction 4 and extend in the front and rear directions 6, 7. A front end or rear end of each of the ribs 126 is bent in one or both of the right direction 8 and the left direction 9. Thus, each of the ribs 126 is shaped like a hook in plan view. The ribs 126 are spaced apart from each other in the right and left directions 8, 9.

As illustrated in FIG. 9, a bottom area S1 of the first body 111 is smaller than a bottom area S2 of the second body 112 (S1<S2). The bottom areas of the first body 111 and the second body 112 are projected areas of the bottom board 118 and the bottom board 124 in the vertical direction in a state in which the bottom board 118 of the first body 111 and the bottom board 124 of the second body 112 extend in the horizontal direction.

As illustrated in FIG. 9, the height H1 of the first body 111 is greater than the height H2 of the second body 112 (H1>H2). Each of the heights H1, H2 of the first body 111 and the second body 112 is defined as a dimension of a corresponding one of the side wall 117 and the side wall 123 in the vertical direction in a state in which the bottom board 118 of the first body 111 and the bottom board 124 of the second body 112 extend in the horizontal direction.

An engaging portion 127 is provided on the second body 112 at its central portion in the right and left directions 8, 9 so at to protrude from the bottom board 124 in the up direction 4. The engaging portion 127 has a generally rectangular parallelepiped shape. An engaging hook 129 is provided on a rear surface 128 of the engaging portion 127. The engaging hook 129 protrudes in the up direction 4 so as to gradually increase a distance from the rear surface 128 to the engaging hook 129. A protruding end of the engaging hook 129 is bent like a hook. The engaging hook 129 is elastically deformable so as to move toward the rear surface 128.

As illustrated in FIG. 4, a through hole 37 is formed in the bottom board 31B of the lower cover 30. The through hole 37 has a rectangular shape in plan view which corresponds to the outer shape of the engaging portion 127. The engaging portion 127 is fitted in the through hole 37. The engaging hook 129 is engaged with an edge of the through hole 37 in the state in which the engaging portion 127 is fitted in the through hole 37. This engagement secures the second body 112 in a state in which the second body 112 is located under the bottom board 31A of the lower cover 30, thereby preventing disengagement of the second body 112 from the lower cover 30 in the down direction 5.

As illustrated in FIG. 10, the second body 112 is provided with two bosses 131 protruding from the bottom board 124 in the up direction 4. Each of the bosses 131 has a cylindrical shape. Screws 139 (see FIG. 8) are to be inserted in the respective bosses 131.

The side wall 117 of the first body 111 is open at a portion facing the second body 112, and the side wall 123 of the second body 112 is open at a portion facing the first body 111. These openings serve as one opening 130. The inner space of the first body 111 and the inner space of the second body 112 communicate with each other through the opening 130.

Figure 12:
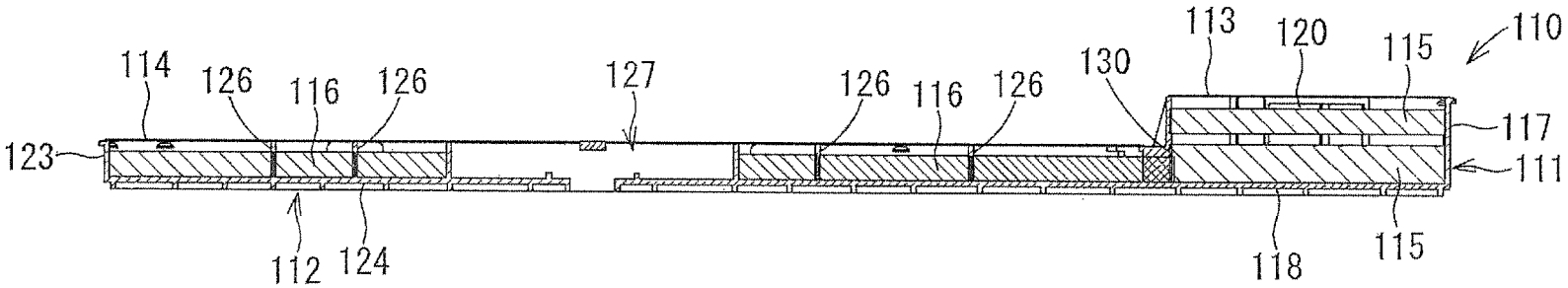
FIG. 12 is a cross-sectional view taken along line XII-XII in FIG. 9.

As illustrated in FIG. 12, the ink absorber 115 is provided in the inner space of the first body 111. The ink absorber 115 is formed of a fabric material and constituted by a felt component, for example. The ink absorber 115 is also disposed in the projection 120.

As illustrated in FIG. 8, in a state in which the second body 112 is located under the bottom board 31A of the lower cover 30 and between the ribs 38, 39, i.e., in a state in which the second body 112 is located in the space 43, the screws 139 inserted through the respective bosses 131 are engaged with the bottom board 31A of the lower cover 30, thereby securing the second body 112 to the lower cover 30. The opening 125 formed in the second body 112 is closed by the sheet 114 except for the engaging portion 127 and the bosses 131.

The first body 111 and the second body 112 are formed integrally with each other in a state in which the first body 111 is located to the right of the second body 112. That is, the first body 111 and the second body 112 are connected to each other. Thus, when the second body 112 is secured to the bottom board 31A of the lower cover 30, the first body 111 is also secured to the lower cover 30. In this state, the first body 111 is located under the bottom board 31B of the lower cover 30, that is, the first body 111 is located in the space 44. In the state in which the second waste-liquid tank 110 is secured to the lower cover 30, the first body 111 and the second body 112 do not overlap the first reinforcement 41 and the second reinforcement 42 when viewed from an upper side in the up and down directions 4, 5. In other words, the first body 111 and the second body 112 are different in position from the first reinforcement 41 and the second reinforcement 42 in the up and down directions 4, 5. When the screws 139 are removed in this state, the second waste-liquid tank 110 is removable from a lower surface of the lower cover 30 in the down direction 5.

As illustrated in FIG. 8, each of a position of a lower end of the first body 111 and a position of a lower end of the second body 112 is located higher than positions of lower ends of the respective ribs 38, 39 in the state in which the second waste-liquid tank 110 is secured to the lower cover 30. The position of the lower end of the first body 111 and the position of the lower end of the second body 112 are the same as each other in the up and down directions 4, 5.

Figure 15:
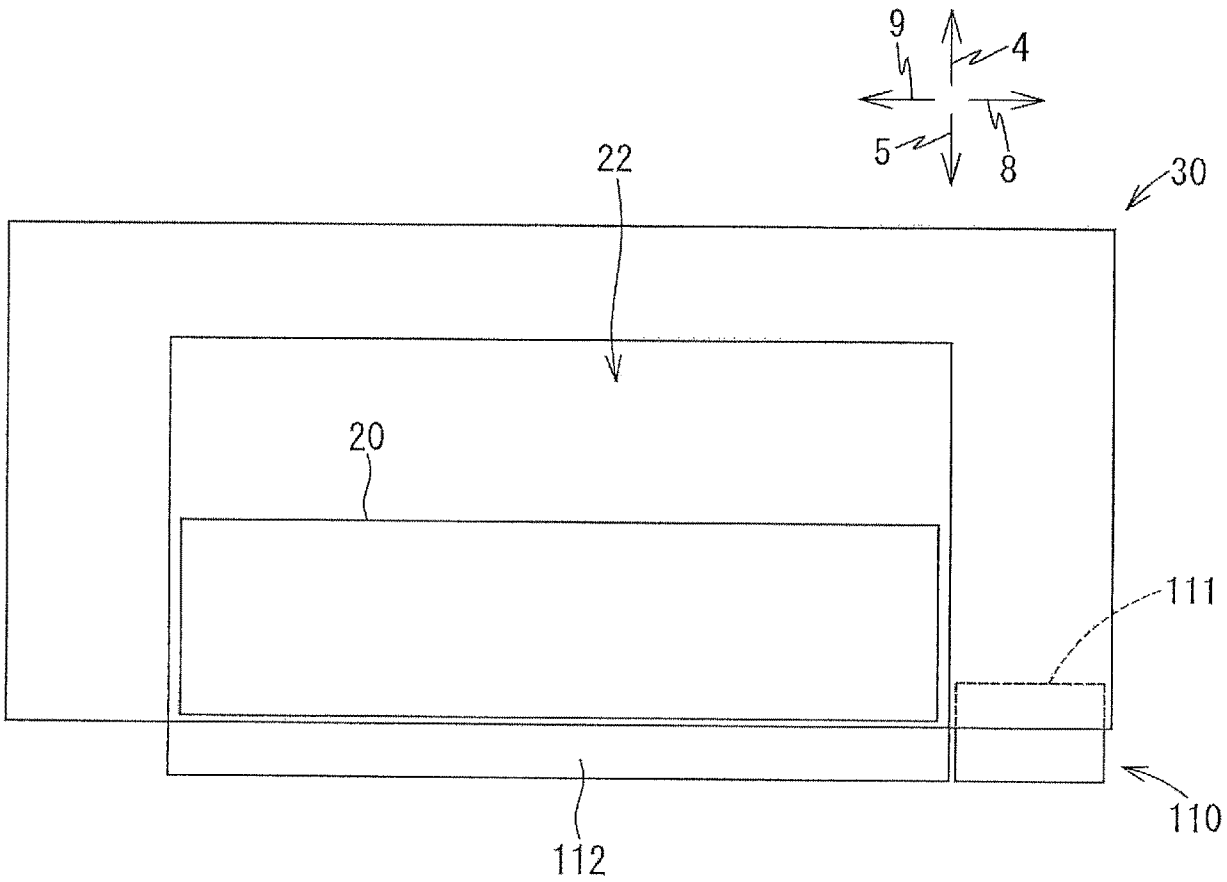
FIG. 15 is a schematic view of a supply tray, the lower cover, the first waste-liquid tank, and the second waste-liquid tank.

As illustrated in FIG. 15, the first body 111 is located to the right of (on a side of) the supply tray 20 in the state in which the second waste-liquid tank 110 is secured to the lower cover 30. As illustrated in FIG. 2, the second body 112 is disposed under the supply tray 20. Since the position of the lower end of the first body 111 and the position of the lower end of the second body 112 are the same in the up and down directions 4, 5, and the height H1 of the first body 111 is lower than the height H2 of the second body 112, a position of an upper end of the first body 111 is higher than a position of an upper end of the second body 112. Each of the position of the upper end of the first body 111 and the position of the upper end of the second body 112 may be respectively defined as positions of the upper ends of the respective side walls 117, 123 and may be respectively defined as positions of upper surfaces of the respective sheets 113, 114, for example.

Figure 13:
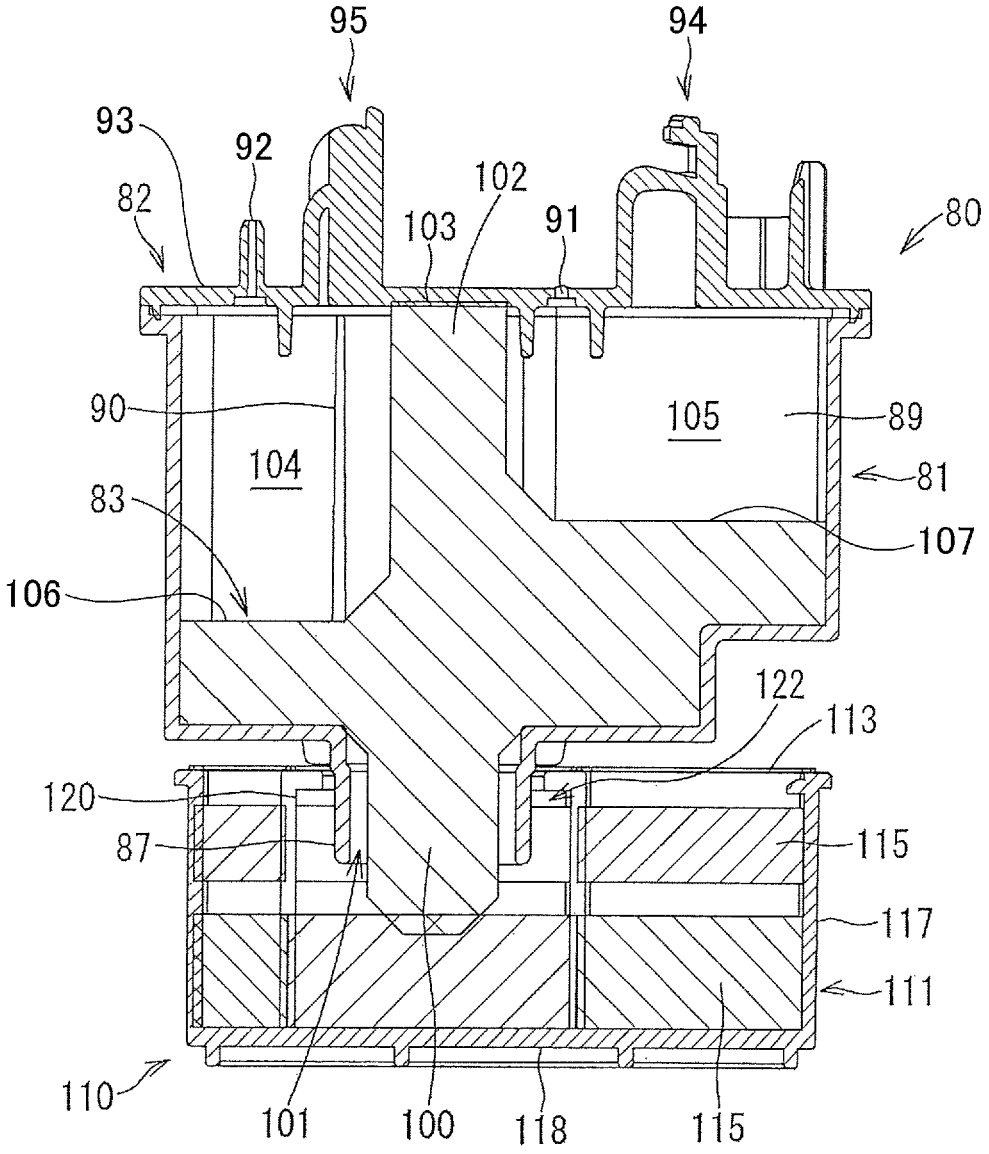
FIG. 13 is a cross-sectional view taken along line XIII-XIII in FIG. 12.

As illustrated in FIG. 13, in the state in which the first waste-liquid tank 80 and the second waste-liquid tank 110 are secured to the lower cover 30, the ink absorber 83 protruding to the outside of the first waste-liquid tank 80 from the cylindrical portion 87 of the body 81 of the first waste-liquid tank 80 enters the inner space of the second waste-liquid tank 110 through the opening 122 of the projection 120 of the second waste-liquid tank 110, and the ink absorber 83 is in pressing contract with the ink absorber 115. In this state, the first waste-liquid tank 80 is located on a waste ink path between the purging mechanism 70 and the second waste-liquid tank 110. The waste ink having flowed into the inner space of the body 81 flows into the inner space of the first body 111 of the second waste-liquid tank 110 through the ink absorber 83 and absorbed and retained by the ink absorber 115. It is noted that an inlet of the waste ink path is defined by the caps 74, 75.

As illustrated in FIG. 12, the ink absorber 116 is provided in the inner space of the second body 112. The ink absorber 116 is formed of a fabric material and constituted by a felt component, for example. The ink absorber 115 provided in the inner space of the first body 111 and the ink absorber 116 provided in the inner space of the second body 112 are held in contact with each other through the opening 130. Thus, the waste ink having flowed into the inner space of the first body 111 flows into the inner space of the second body 112 through the ink absorber 115 and absorbed and retained by the ink absorber 116. It is noted that a portion of the first protrusion 100 which is located in the space 101 and a portion of the first protrusion 100 which protrudes from the space 101 and is in contact with the ink absorber 116 are one example of a second waste-ink path, for example.

In the case where the second waste-liquid tank 110 is filled to capacity with the waste ink, only the second waste-liquid tank 110 is removed from the lower cover 30 and replaced with new one. That is, the second waste-liquid tank 110 can be replaced only by removing the screws 139 securing the second waste-liquid tank 110 from a lower portion of the MFP 10 to disengage the engaging portion 127 of the second waste-liquid tank 110 from the lower cover 30, without disassembling the MFP 10 to such a degree that a user can access the internal structure of the printer 14 such as the purging mechanism 70. During this replacement, the stored waste ink is absorbed and retained in the ink absorber 83 in the first waste-liquid tank 80. Accordingly, even when the cylindrical portion 87 of the first waste-liquid tank 80 is exposed to the outside by removal of the second waste-liquid tank 110 from the lower cover 30, the waste ink does not drip or flow to the outside from the first waste-liquid tank 80.

Effects

In the present embodiment, the first body 111 is disposed on a side of the supply tray 20, and the second body 112 is disposed under the supply tray 20. The capacity of the second waste-liquid tank 110 is increased by the effective use of the spaces 43, 44 formed under the lower cover 30. Furthermore, the efficient arrangement prevents increase in size of the MFP 10.

The position of the upper end of the first body 111 is higher than the position of the upper end of the second body 112 in the state in which the second waste-liquid tank 110 is secured to the lower cover 30, resulting in reduction in thickness of the MFP 10.

The bottom area S1 of the first body 111 is smaller than the bottom area S2 of the second body 112, and the height H1 of the first body 111 is higher than the height H2 of the second body 112. This construction reduces the increase in size of the MFP 10 while increasing the capacity of the second waste-liquid tank 110. That is, since the first body 111 does not overlap the supply tray 20 when viewed from an upper side in the up and down directions 4, 5, an increase in the height H1 for a larger capacity of the first body 111 has little effect on reduction in thickness of the MFP 10. On the other hand, the bottom board 31B of the lower cover 30 needs to be made larger to increase the bottom area S1 of the first body 111. This increase may lead to a larger size of the MFP 10 in the front and rear directions 6, 7 and the right and left directions 8, 9, resulting in the increase in size of the MFP 10.

Regarding the second body 112 overlapping the supply tray 20 in the up and down directions 4, 5, even in the case where the bottom area S2 is increased to an area equal to that of the supply tray 20 to increase the capacity of the second body 112, the size of the MFP 10 does not increase. In contrast, if the height H2 of the second body 112 is increased, the components including the supply tray 20 and the image recorder 24 are located at higher positions in the up direction 4, not leading to reduction in thickness of the MFP 10. For the reasons described above, the first body 111 and the second body 112 are constructed as described above to reduce the increase in size of the MFP 10 while increasing the capacity of the second waste-liquid tank 110.

The ribs 38, 39 are provided on the lower cover 30 to increase the flexural rigidity of the lower cover 30 in the right and left directions 8, 9. The positions of the lower ends of the first body 111 and the second body 112 are located higher than the positions of the lower ends of the ribs 38, 39 in the state in which the second waste-liquid tank 110 is secured to the lower cover 30. This construction prevents direct contact of the first body 111 and the second body 112 with the surface on which the MFP 10 is placed. Thus, no load is applied from the MFP 10 to the first body 111 and the second body 112. Accordingly, the first body 111 and the second body 112 can be arranged with effective use of a space formed between the ribs 38, 39 and the surface on which the MFP 10 is placed.

The second waste-liquid tank 110 is removable in the down direction 5 from the lower surface of the lower cover 30 without interference with the ribs 38, 39.

The second waste-liquid tank 110 does not overlap the first reinforcement 41 and the second reinforcement 42 when viewed from an upper side in the up and down directions 4, 5, resulting in reduction in thickness of the MFP 10.

The first waste-liquid tank 80 is disposed in the space 35 located over the bottom board 31B of the lower cover 30, and the waste ink flows from the purging mechanism 70 into the second waste-liquid tank 110 via the first waste-liquid tank 80. A buffer area for the waste ink is provided between the purging mechanism 70 and the second waste-liquid tank 110. Also, the waste ink is retained by the ink absorber 83 of the first waste-liquid tank 80. Thus, even when the second waste-liquid tank 110 is removed from the lower cover 30 in replacement of the second waste-liquid tank 110, and the cylindrical portion 87 of the first waste-liquid tank 80 is exposed from the lower cover 30 through the through hole 36, it is possible to prevent the waste ink from flowing from the first waste-liquid tank 80 to the outside of the MFP 10.

Modifications

While the first body 111 and the second body 112 of the second waste-liquid tank 110 are formed integrally with each other in the above-described embodiment, the first body 111 and the second body 112 may be independent of each other.

In the above-described embodiment, the purging mechanism 70 sucks the ink from the recording head 65, and the waste ink is received by the caps 74, 75. Instead of this construction, a purging mechanism of what is called a pushing purging type may be employed. That is, the MFP 10 may be configured such that a pump is provided between the recording head 65 and the ink cartridges, and the pump is operated to apply pressure to ink passages formed in the recording head 65 to push the ink out of the recording head 65. In this construction, the caps 74, 75 do not necessarily cover the nozzles 69 of the recording head 65, and the caps 74, 75 may be spaced apart from the nozzles 69 as long as the caps 74, 75 can receive the waste ink discharged from the nozzles 69 of the recording head 65.

The lid 82 may be provided with protrusions to be in contact with the second protrusion 102 of the ink absorber 83 to press the ink absorber 83 in the down direction 5, for example. These protrusions apply a pressing force to the ink absorber 83 in the down direction 5 in the body 81, whereby the first protrusion 100 of the ink absorber 83 reliably protrudes from the cylindrical portion 87 to the outside.

While the first waste-liquid tank 80 and the second waste-liquid tank 110 are arranged in the up and down directions 4, 5 in the above-described embodiment, the present disclosure is not limited to this arrangement. For example, the first waste-liquid tank 80 and the second waste-liquid tank 110 may be arranged in the front and rear directions 6, 7 or the right and left directions 8, 9. In this construction, the first protrusion 100 of the ink absorber 83 of the first waste-liquid tank 80 may protrude from the body 81 to the outside in the front direction 6, the rear direction 7, the right direction 8, or the left direction 9.

What is claimed is:

1. A liquid consuming apparatus, comprising:

a liquid consumer that consumes liquid;

a liquid receiver that receives the liquid discharged from the liquid consumer;

a first waste-liquid storage connected to the liquid receiver so as to allow communication of the liquid therebetween;

a second waste-liquid storage connected to the first waste-liquid storage such that an inner space of the first waste-liquid storage and an inner space of the second waste-liquid storage directly communicate with each other;

a housing; and a sheet tray supported by the housing, the first waste-liquid storage being disposed on a side of the sheet tray, the second waste-liquid storage being disposed under the sheet tray, wherein the second waste-liquid storage overlaps the sheet tray when viewed from an upper side in an up and down direction.

2. The liquid consuming apparatus according to claim 1, wherein an upper end of the first waste-liquid storage is located above an upper end of the second waste-liquid storage.

3. The liquid consuming apparatus according to claim 1, wherein a bottom area of the first waste-liquid storage is less than that of the second waste-liquid storage, and wherein a height of the first waste-liquid storage is greater than that of the second waste-liquid storage.

4. The liquid consuming apparatus according to claim 1, wherein the housing comprises at least one rib protruding downward from a lower surface of the housing, and wherein a lower end of the first waste-liquid storage and a lower end of the second waste-liquid storage are located above a lower end of the at least one rib.

5. The liquid consuming apparatus according to claim 4, wherein the at least one rib comprises a plurality of ribs extending in a first direction in which the sheet tray and the first waste-liquid storage are arranged, wherein the plurality of ribs are spaced apart from each other in a second direction orthogonal to the first direction, and wherein at least the second waste-liquid storage of the first waste-liquid storage and the second waste-liquid storage is disposed between the plurality of ribs.

6. The liquid consuming apparatus according to claim 1, wherein the first waste-liquid storage and the second waste-liquid storage are removable downward from a lower surface of the housing.

7. The liquid consuming apparatus according to claim 1, further comprising:

a roller that conveys a sheet supported by the sheet tray; and a first reinforcement disposed on a lower surface of the housing below the roller, wherein the first waste-liquid storage and the second waste-liquid storage do not overlap the first reinforcement when viewed from an upper side in an up and down direction.

8. The liquid consuming apparatus according to claim 1, wherein the sheet tray is supported in a state in which the sheet tray protrudes frontward from the housing, wherein the liquid consuming apparatus further comprises a second reinforcement disposed on a front portion of a lower surface of the housing, and wherein the first waste-liquid storage and the second waste-liquid storage do not overlap the second reinforcement when viewed from an upper side in an up and down direction.

9. The liquid consuming apparatus according to claim 1, wherein a third waste-liquid storage is disposed in the housing at a position located between the liquid receiver and the first waste-liquid storage, and wherein a liquid absorber of the first waste-liquid storage and a liquid absorber of the third waste-liquid storage are held in contact with each other.

10. An ink-jet printer, comprising:

an ink-jet head;

a first waste-ink storage;

a second waste-ink storage;

a first waste-ink path connected to the first waste-ink storage, the first waste-ink path being connectable to the ink-jet head, wherein the first waste-ink storage is communicated with the ink-jet head via the first waste-ink path when the first waste-ink path is connected to the ink-jet head;

a second waste-ink path connected to the first waste-ink storage and the second waste-ink storage, wherein the second waste-ink storage is communicated with the ink-jet head via the first ink path and the second ink path when the first ink path is connected to the ink-jet head, an inner space of the first waste-ink-storage and an inner space of the second waste-ink storage communicating each other through the second waste-ink path;

a housing; and a sheet tray supported by the housing, wherein the first waste-ink storage is disposed on a side of the sheet tray, and the second waste-ink storage is disposed under the sheet tray.

11. The ink-jet printer according to claim 10, wherein the second waste-ink storage overlaps the sheet tray when viewed from an upper side in an up and down direction.

12. An ink-jet printer, comprising:

an ink-jet head;

a first waste-ink storage;

a second waste-ink storage connected to the first waste-ink storage such that an inner space of the first waste-ink storage and an inner space of the second waste-ink storage directly communicate with each other;

a waste-ink path comprising an inlet and an outlet, the outlet being connected to first ink storage, the inlet being connectable to the ink-jet head;

a housing; and a sheet tray supported by the housing, wherein the first waste-ink storage is disposed on a side of the sheet tray, and the second waste-ink storage is disposed under the sheet tray, wherein the second waste-ink storage overlaps the sheet tray when viewed from an upper side in an up and down direction.

13. The ink-jet printer according to claim 12, wherein the inlet of the first ink path is defined by a cap.

14. A liquid consuming apparatus, comprising:

a liquid consumer that consumes liquid;

a liquid receiver that receives the liquid discharged from the liquid consumer;

a first waste-liquid storage connected to the liquid receiver so as to allow communication of the liquid therebetween;

a second waste-liquid storage connected to the first waste-liquid storage such that an inner space of the first waste-liquid storage and an inner space of the second waste-liquid storage directly communicate with each other;

a housing; and a sheet tray supported by the housing, the first waste-liquid storage being disposed on a side of the sheet tray, the second waste-liquid storage being disposed under the sheet tray, wherein a bottom area of the first waste-liquid storage is less than that of the second waste-liquid storage, and wherein a height of the first waste-liquid storage is greater than that of the second waste-liquid storage.

15. A liquid consuming apparatus, comprising:

a liquid consumer that consumes liquid;

a liquid receiver that receives the liquid discharged from the liquid consumer;

a first waste-liquid storage connected to the liquid receiver so as to allow communication of the liquid therebetween;

a second waste-liquid storage connected to the first waste-liquid storage such that an inner space of the first waste-liquid storage and an inner space of the second waste-liquid storage directly communicate with each other;

a housing; and a sheet tray supported by the housing, the first waste-liquid storage being disposed on a side of the sheet tray, the second waste-liquid storage being disposed under the sheet tray, wherein the first waste-liquid storage and the second waste-liquid storage are removable downward from a lower surface of the housing.

16. A liquid consuming apparatus, comprising:

a liquid consumer that consumes liquid;

a liquid receiver that receives the liquid discharged from the liquid consumer;

a first waste-liquid storage connected to the liquid receiver so as to allow communication of the liquid therebetween;

a second waste-liquid storage connected to the first waste-liquid storage such that an inner space of the first waste-liquid storage and an inner space of the second waste-liquid storage directly communicate with each other;

a housing; and a sheet tray supported by the housing, the first waste-liquid storage being disposed on a side of the sheet tray, the second waste-liquid storage being disposed under the sheet tray, wherein a third waste-liquid storage is disposed in the housing at a position located between the liquid receiver and the first waste-liquid storage, and wherein a liquid absorber of the first waste-liquid storage and a liquid absorber of the third waste-liquid storage are held in contact with each other.

* * * * *